US006498597B1

(12) United States Patent
Sawano

(10) Patent No.: US 6,498,597 B1
(45) Date of Patent: Dec. 24, 2002

(54) CONTINUOUSLY DISPLAYABLE SCROLL-TYPE DISPLAY

(75) Inventor: Mitsuru Sawano, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/429,279

(22) Filed: Oct. 28, 1999

(30) Foreign Application Priority Data

Oct. 28, 1998 (JP) ..... 10-307288

(51) Int. Cl.[7] ..... G09G 3/34
(52) U.S. Cl. ..... 345/107; 345/905
(58) Field of Search ..... 345/107

(56) References Cited

U.S. PATENT DOCUMENTS 3,466,776 A * 9/1969 Paige ..... 40/517
5,081,690 A * 1/1992 Tan ..... 358/466
5,717,514 A * 2/1998 Sheridon ..... 359/296
5,848,634 A * 12/1998 Will et al. ..... 160/310
6,017,584 A * 1/2000 Albert et al. ..... 427/213.3
6,118,426 A * 9/2000 Albert et al. ..... 345/107
6,236,812 B1 * 5/2001 Hata ..... 396/6

* cited by examiner

*Primary Examiner*—Richard Hjerpe
*Assistant Examiner*—William C. Spencer
(74) *Attorney, Agent, or Firm*—Sughrue Mion, PLLC

(57) ABSTRACT

A writable and erasable flexible medium 2 as display is stored in a cylindrical magazine type case 3 as a scroll so that the flexible medium can be rewound. Write and read can be executed by means of a CPU, write head, scanner, etc., contained in the case 3, and additional write, erasion, etc., with a write pen 5 can also be performed as desired.

14 Claims, 11 Drawing Sheets

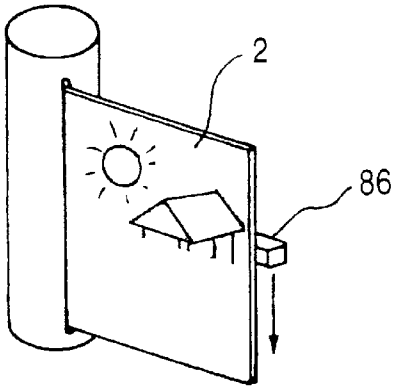
FIG. 8A
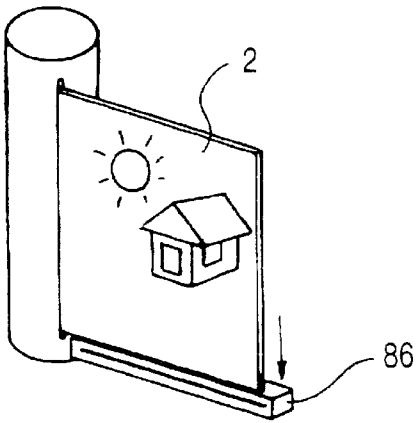
FIG. 8B
FIG. 8C
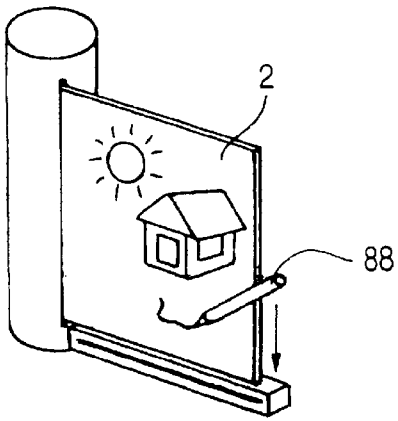
FIG. 8D
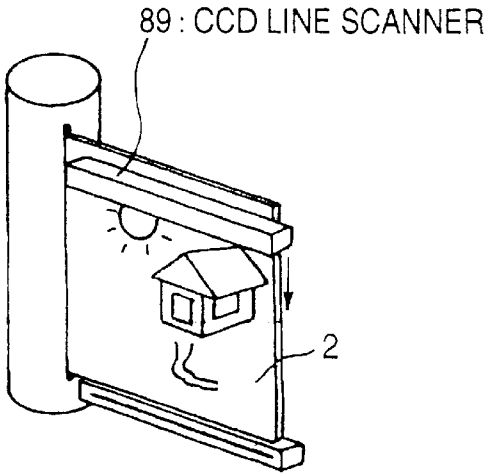
FIG. 8E

CONTINUOUSLY DISPLAYABLE SCROLL-TYPE DISPLAY

BACKGROUND OF THE INVENTION

1. Field of the Invention

This invention relates to a display unit and in particular to a display unit using a scroll-like flexible medium which is writable and erasable at high speed and continuously displayable.

2. Description of the Related Art

Background display units include display units using liquid crystal used for applications from monochrome LCD of a watch, a camera, etc., to color LCD of a color TV, a personal computer, etc., LED used mainly for segment display, etc., and plasma enabling a large-sized and flat color display to be formed by discharge light emission.

However, with the background display units of liquid crystal, LED, plasma, etc., if power is turned off, display also all disappears, and the display operation of power reduction and storage holding type capable of holding display if power is turned off cannot be performed. Therefore, if an attempt is made to leave a display image, an image printing method on a printer, etc., is only available, thus paper is consumed each time printing is executed.

In recent years, displays capable of performing the display operation of storage holding type with a writable and erasable record medium by applying an electric field, heat, or magnetism have also been developed.

For example, a sheet-like electric field display is introduced as "gyricon electric paper" in journal "SID 98 DIGEST" p.1010 to p.1013. That is, it is a display 0.12 to 0.8 mm thick comprising dichroic spheres 25 to 100 m in diameter bonded between polyester sheets. An electric field (for example, 40 nanojoule/square centimeter) is applied to the space between the polyester sheets, whereby the dichroic spheres are rotated and are inverted in direction and the color appearing so far disappears and another color appears. After the sphere is once rotated, it is deposited on the wall face of the hollow storing the sphere, thus after the electric field is removed, the state is still maintained. That is, the record state is continuously displayed. An electric field is given reversely, whereby the record is erased.

A sheet-like heat display is introduced in, for example, "Denshi jouhou tuushin gakkai gijyutu kenkyuu houkoku CPM83-18." That is, if external heat is applied to a heat medium for setting the temperature of the medium to a predetermined temperature or more, a color different from the initial color is presented; if the medium is cooled, the color is restored to the former color. For example, Ag2HgI4 is available as the material and the color becomes yellow at a predetermined temperature or less and becomes orange at the predetermined temperature or more. Ag2HgI4 is applied onto a transparent polyester film and this film and another transparent polyester film are placed to form a sandwich via an adhesive layer. Information is recorded with a thermal head, is held at normal temperature or by a heater, and is erased electronically with an electronic cooler using the Peltier effect. The display is placed on a row for line-sequential display or is placed like a plane for plane-sequential display.

A sheet-like magnetic display is also known. Using a magnetism phenomenon in which a magnet attracts iron powder, magnetic energy is given to a record medium through a record head, whereby magnetic powder (toner) is attracted. The magnetic powder is continuously attracted onto the record medium because of residual magnetism still after the magnetic energy is removed. For erasion, the residual magnetism is demagnetized by an erasion head. For example, γ-Fe2O3, Co—Ni—P, CrO2, etc., is used as the magnetic powder material.

A display unit has been known wherein such continuously displayable record media under electric field control, heat control, or magnetism control are used to make up a display panel or are concatenated like a ring for forming endless paper and the display panel or endless paper is combined with a line head and wherein when information is changed, the head is driven at the same time as the endless medium rotates or the head moves, and new display contents are rewritten.

However, the display made up of such record media is like a panel or endless paper and lacks portability or practical utility.

SUMMARY OF THE INVENTION

It is therefore an object of the invention to provide a scroll-type display wherein by writing an image onto a scroll-like writable and erasable flexible medium using an electric or magnetic write head, high-speed image rewrite display is enabled on the flexible display medium, wherein the display operation of power reduction type is enabled so that display of the written image can be held if a drive source is removed, and wherein an image can be displayed in such a manner that the writable and erasable flexible display medium can be fed out from and inserted into a magazine like a scroll.

In this invention, there is provided a continuously displayable scroll-type display storing a writable and erasable and continuously displayable flexible medium like a scroll as display in a cylindrical magazine type case so that the flexible medium can be wound and/or rewound.

According to a favorable embodiment, the display displays the image based on an electrophoretic effect or magnetic-phoretic effect in the flexible medium.

According to further aspect, the flexible medium contains a mix layer of a particle containing a color substance and a fluid opaque medium.

According to another aspect, the flexible medium contains a mix layer of a particle containing a magnetic substance and a fluid opaque medium.

According to another feature, a display control section containing a CPU for controlling display of the flexible medium is placed in the cylindrical magazine type case.

According to the described configuration, the scroll-like flexible display medium is fed out from the magazine and an image is displayed, then it can be rewound into the magazine. A display is produced under the personal computer control and additional write and write are enabled according to personal computer information. An image can be written onto, erased from, and read from the scroll-like flexible display medium as desired. It is also made possible to communicate with an external computer. The surface of the flexible medium is traced with the additional write pen, whereby display can be added and erased.

BRIEF DESCRIPTION OF THE DRAWINGS

FIGS. 8A to 8E are schematic representations of display of flexible medium shown in FIG. 1;

DESCRIPTION OF THE PREFERRED EMBODIMENTS

Referring now to the accompanying drawings, there is shown a first embodiment of the invention.

Figure 4A:
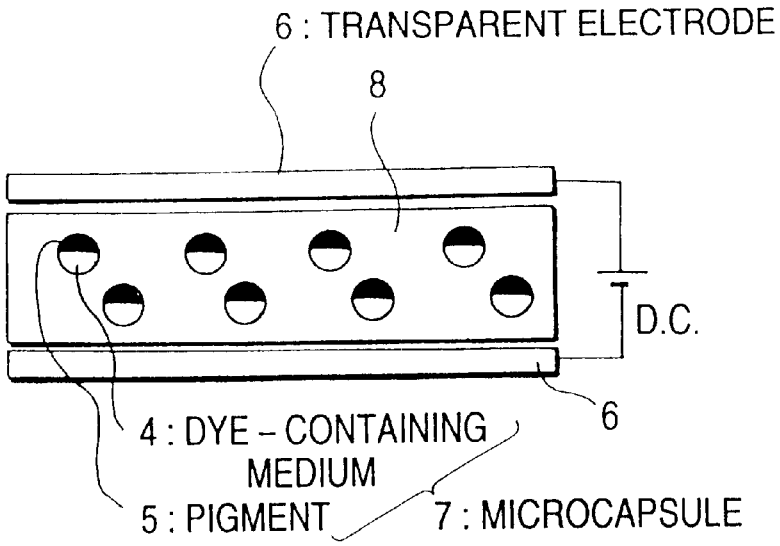
FIGS. 4A to 4C are enlarged sectional views of a microcapsule-type pigment flexible medium in the electric field mode.
Figure 4B:
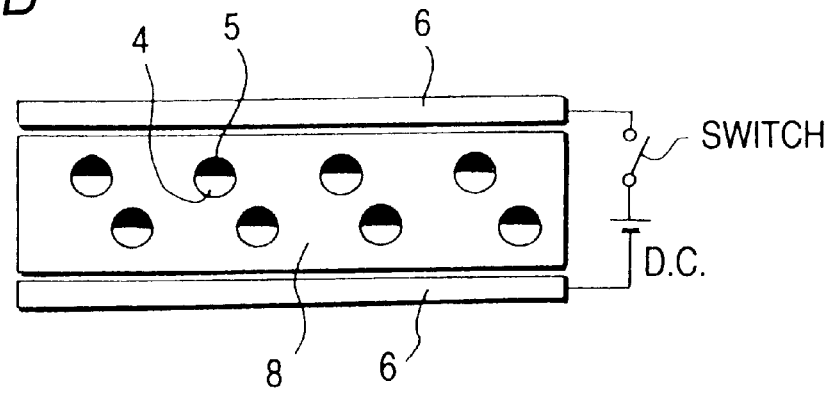
Figure 4C:
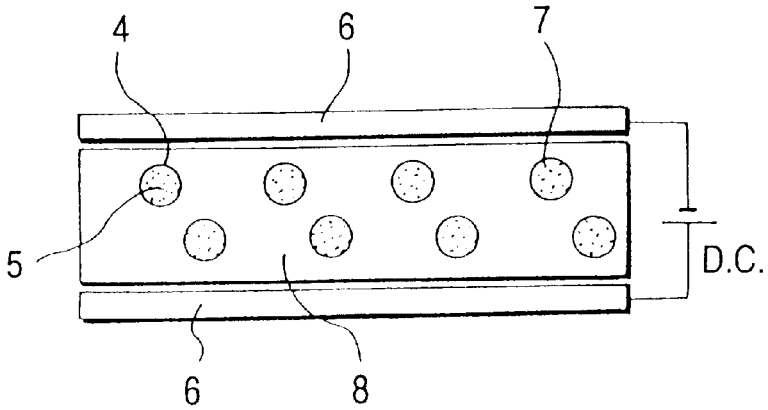
Figure 5A:
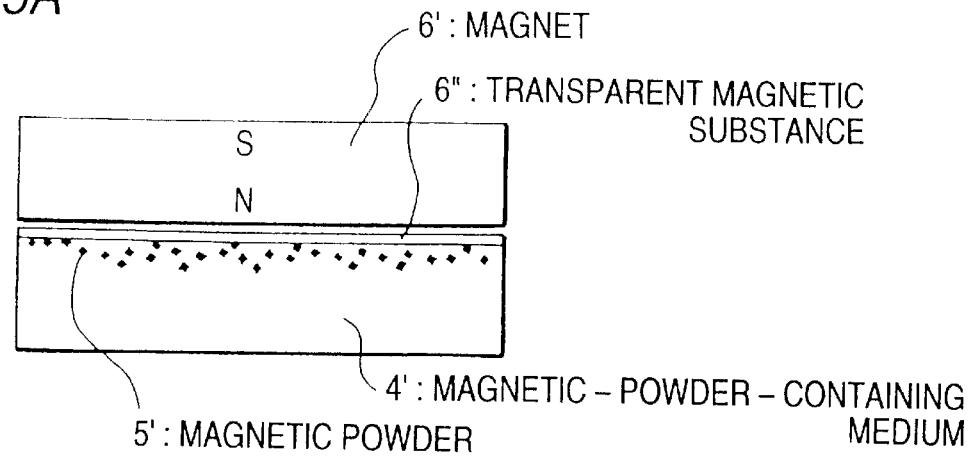
FIGS. 5A to 5C are enlarged sectional views of a capsule-type flexible medium in a magnetic filed mode.
Figure 5B:
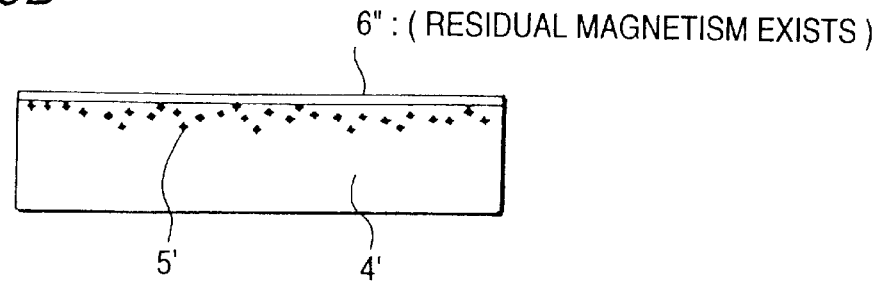
Figure 5C:
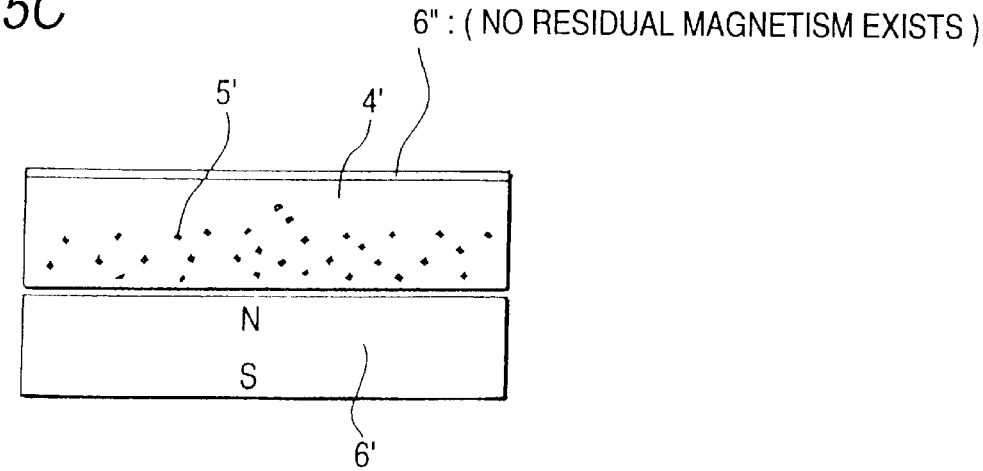
Figure 6A:
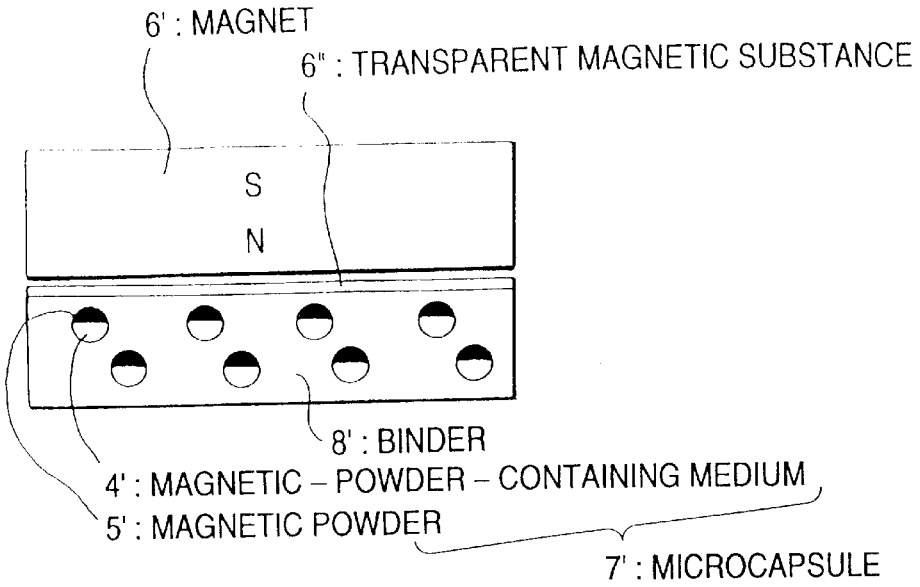
FIGS. 6A to 6C are enlarged sectional views of a microcapsule-type flexible medium in the magnetic filed mode.
Figure 6B:
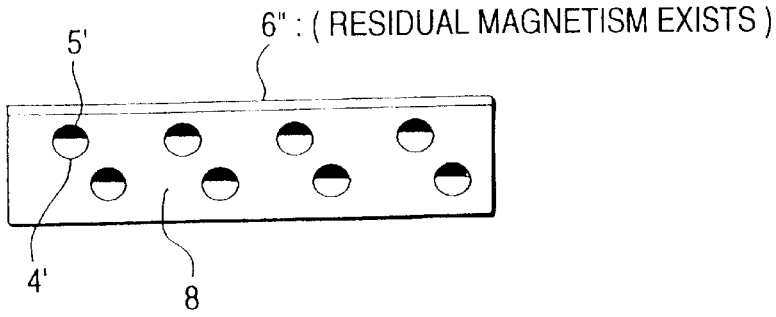
Figure 6C:
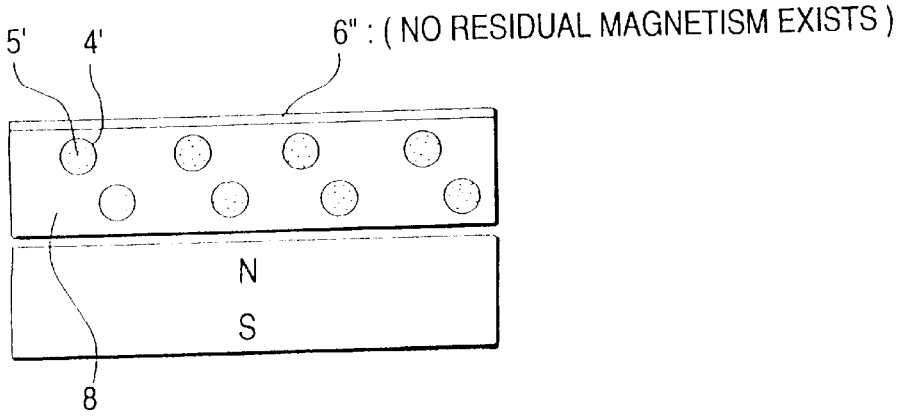

FIGS. 4A to 4C are enlarged sectional views of a microcapsule-type pigment flexible medium in the electric field mode. On the other hand, FIGS. 5A to 5C are enlarged sectional views of a capsule-type flexible medium in a magnetic field mode, and FIGS. 6A to 6C are enlarged sectional views of a microcapsule-type flexible medium in the magnetic field mode.

Figures 7A, 7B:
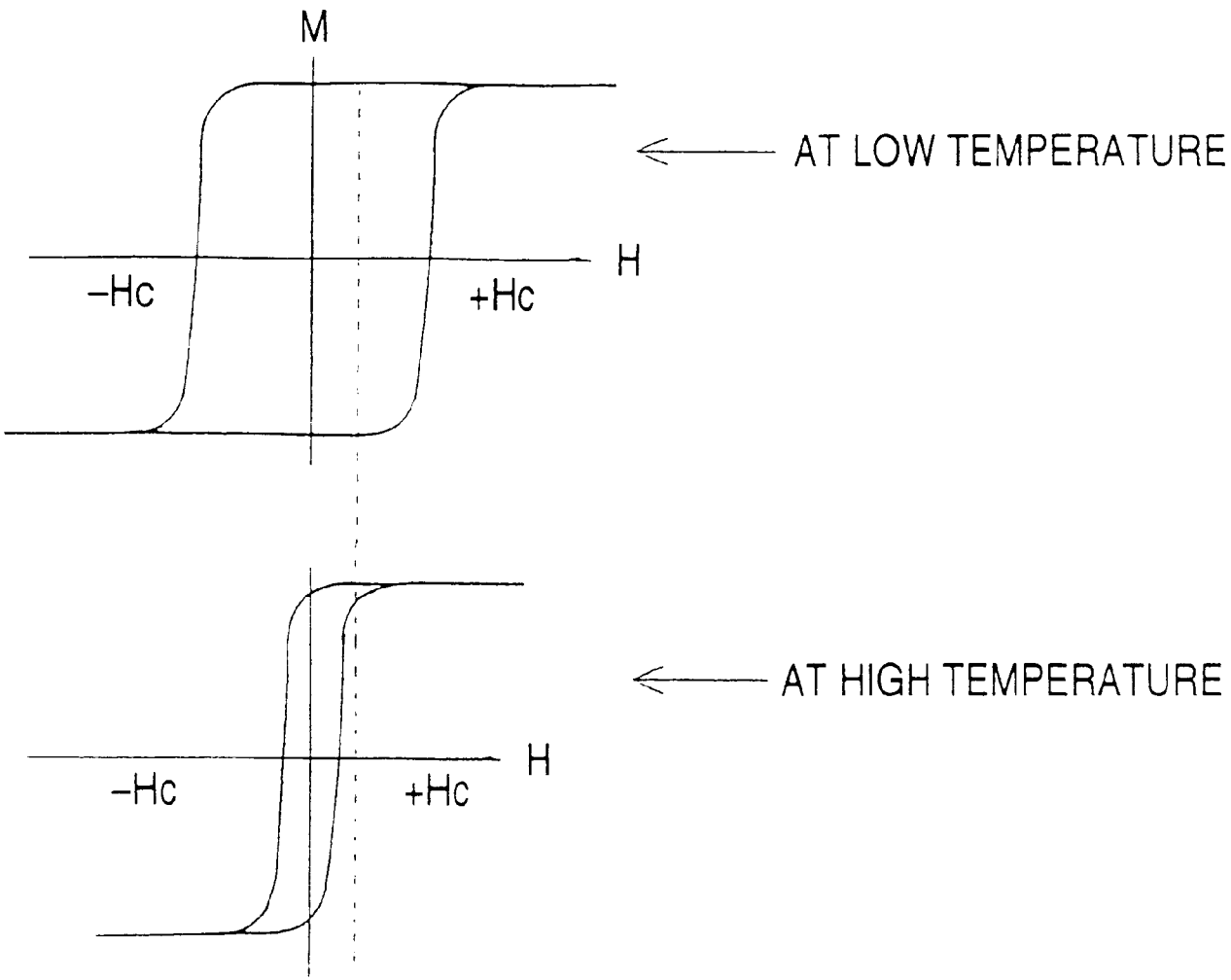
FIGS. 7A and 7B are drawings to show the magnetization characteristic of a magnetic substance to describe the principle of a flexible medium in a heat, magnetic mode.

FIGS. 7A and 7B are drawings to show the magnetization characteristic of a magnetic substance to describe the principle of a flexible medium in a heat, magnetic mode.

Figure 1A:
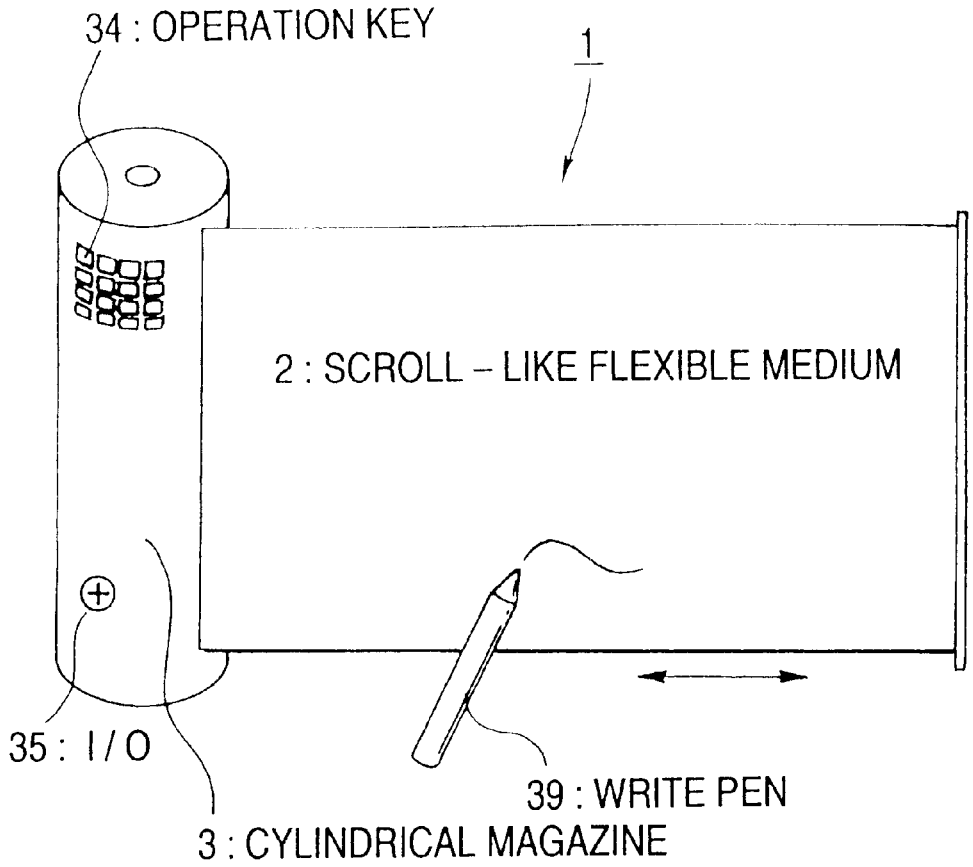
FIG. 1A is a perspective view of a continuously displayable notebook-type scroll-type display according to a first embodiment of the invention and FIG. 1B is a sectional view of a magazine type case.

FIG. 1A is a perspective view of the whole scroll-type display of the invention, wherein numeral 1 denotes the scroll-type display, numeral 2 denotes a continuously displayable flexible medium for display, and numeral 3 is a cylindrical magazine type case for normally winding and storing the flexible medium 2 like a film and rewinding the drawn-out flexible medium 2 by a urging force containing a spring (not shown). Numeral 34 denotes operation keys for operating an internal system (described later) and numeral 35 denotes an I/O terminal for connecting to an external computer, etc.

Figure 1B:
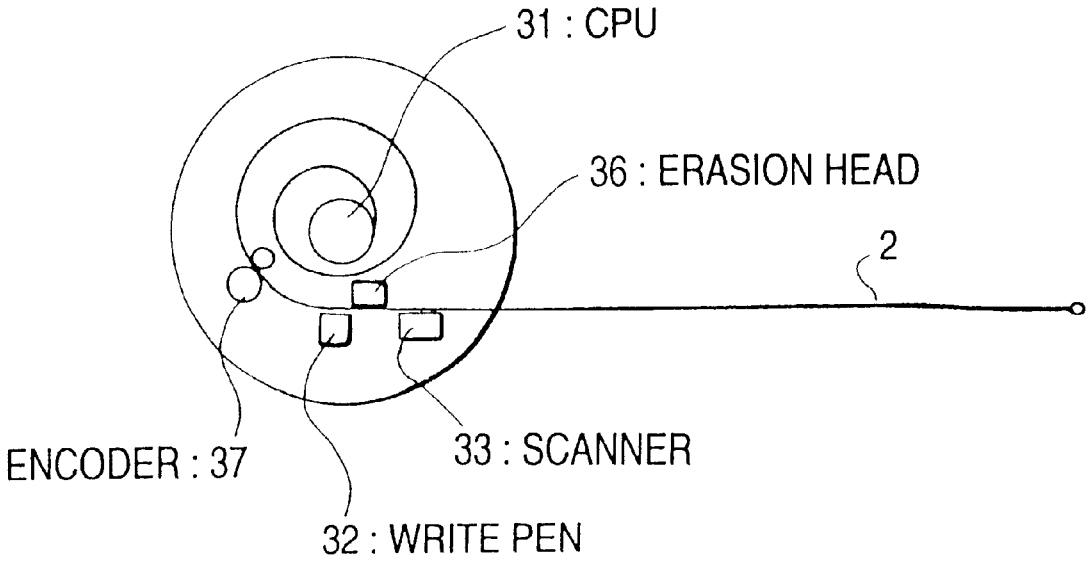

FIG. 1B is a sectional view of the magazine type case shown in FIG. 1A. In FIG. 1B, numeral 31 denotes a cylindrical CPU forming a part of a personal computer, numeral 32 denotes an electric or magnetic write head, numeral 33 denotes a read scanner, and numeral 36 denotes an erasion head. A large number of the magnetic write heads 32, read scanners 33, and erasion heads 36 are arranged in line in a perpendicular direction on the drawing. Numeral 37 denotes an encoder. Since position data of the scroll-like flexible medium 2 (like perforations of a film) is also provided, it is also made possible to find the beginning of a display image, etc.

The flexible medium 2 can display an image using an electrophoretic effect or magnetic-phoretic effect therein. For example, with the capsule-type flexible medium in the electric field mode shown in FIG. 2, dielectric pigment (such as TiO2) 5 is mixed into a medium 4 and an electric field is applied at a transparent electrode 6. When no external electric field is applied, the pigment 5 is uniformly mixed into the medium 4, thus color of the pigment 5 is not conspicuous.

Figure 2A:
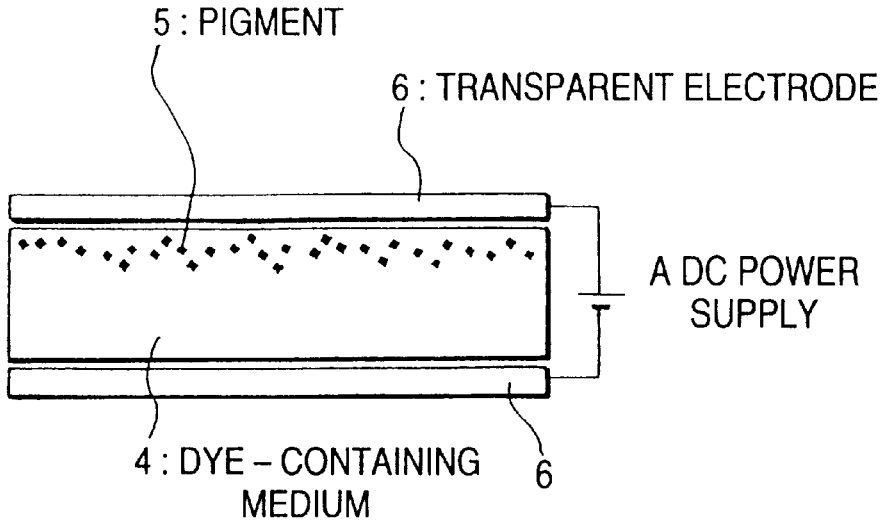
FIGS. 2A to 2C are enlarged sectional views of a capsule-type flexible medium in an electric field mode.
Figure 2B:
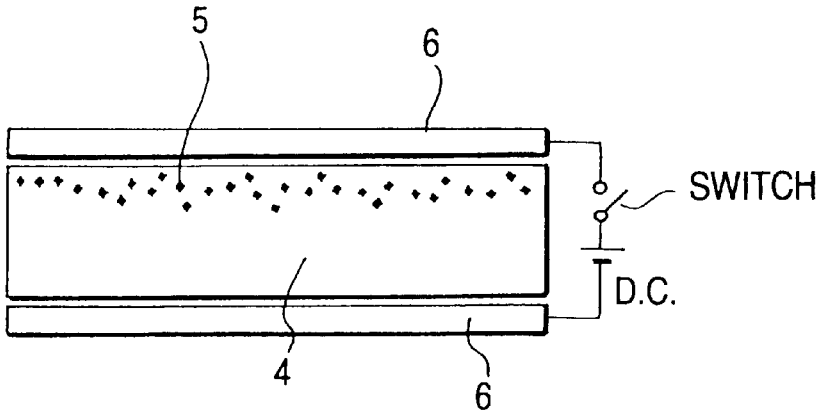

Next, when an external electric field is applied to the transparent electrode 6 from a DC power supply, the dielectric pigment 5 in the medium 4 is polarized or attracted upward in the figure in the medium 4 because of the electric field as in FIG. 2A. Thus, if the capsule is viewed from the top of the figure, the color of the pigment appears. After this, if the DC power supply is turned off for eliminating the electric field, the dielectric pigment 5 in the medium 4 remains polarized or attracted upward in the figure in the medium 4 because of residual charges, frictional resistance, etc., as in FIG. 2B, and the color of the pigment 5 continues.

Figure 2C:
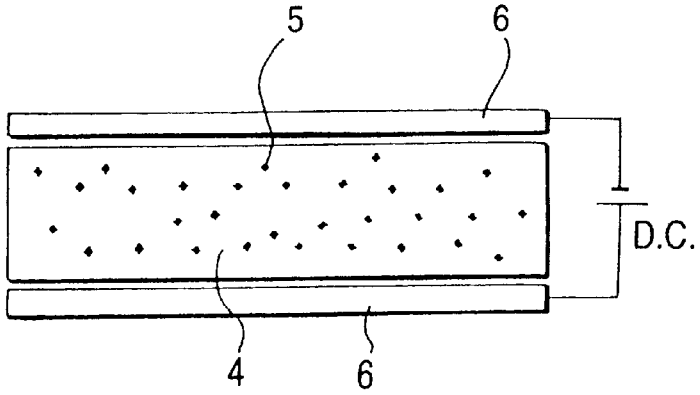

If an external electric field is applied to the transparent electrode 6 from the DC power supply in the opposite direction to that in FIG. 2A, the dielectric pigment 5 polarized or attracted upward is attracted downward and disperses as in FIG. 2C, thus the pigment 5 is uniformly mixed into the medium 4 and color of the pigment 5 becomes inconspicuous. Of course, if the electric field is continuously given in the opposite direction, the pigment 5 is completely polarized or attracted downward in the figure in the medium 4 and the color of the pigment 5 completely disappears.

As the microcapsule-type dichroic ball flexible medium in the electric field mode shown in FIG. 3, for example, a large number of dichroic balls 7 each comprising a color substance A attracted in a positive electric field and a color substance B repelling in a positive electric field, stored in a hollow (microcapsule) are sealed in a binder 8 and an electric field is applied at a transparent electrode 6, 6.

Figure 3A:
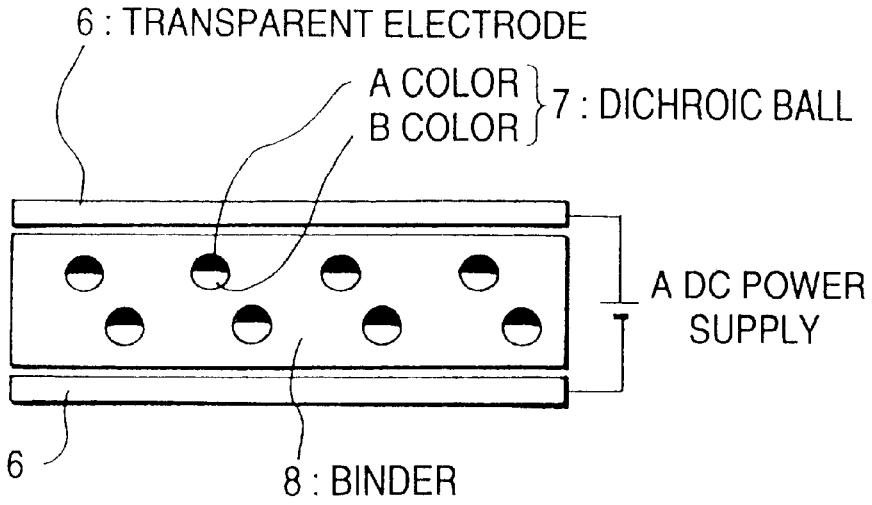
FIGS. 3A to 3C are enlarged sectional views of a microcapsule-type dichroic ball flexible medium in the electric field mode.

When an external electric field is applied to the transparent electrode 6 (positive electric field to the upper transparent electrode 6 in FIG. 3), the color substances A of the dichroic balls 7 attracted in the positive electric field turn upward in union. If the medium is viewed from the top of the figure, the A color of each color substance appears (FIG. 3A).

Figure 3B:
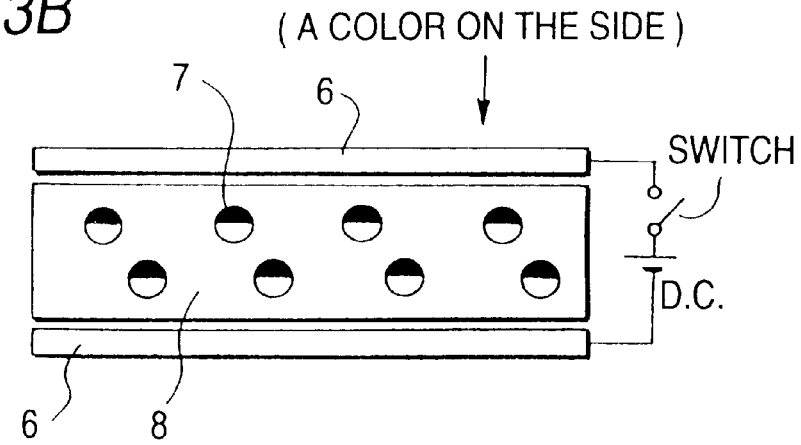

After this, if the external electric field is removed, the A color particles continue the state because of friction with the wall faces of the hollows (FIG. 3B).

Figure 3C:
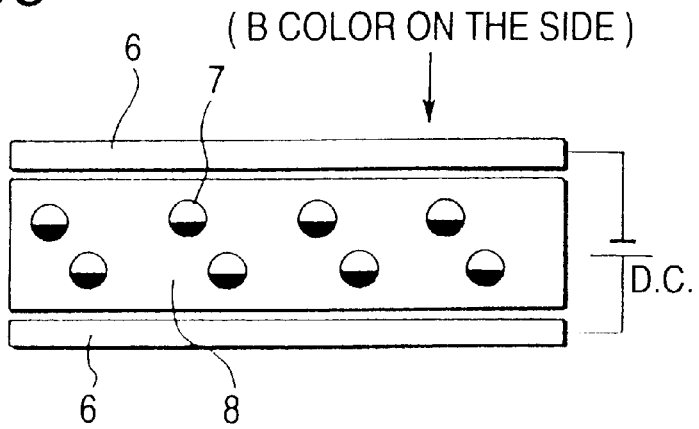

If an external opposite electric field is applied as in FIG. 3C, the color substances A in the microcapsules are attracted downward in the figure and the color substances B repelling in the positive electric field turn upward in the figure in union. Thus, if the medium is viewed from the top, the B color of each color substance appears.

As the microcapsule-type pigment flexible medium in the electric field mode shown in FIG. 4, for example, a large number of microcapsules 7 each comprising pigment 5 attracted in an electric field, mixed into a medium (for example, clouded liquid) 4 are sealed in a binder 8 and an electric field is applied at a transparent electrode 6, 6.

When an external electric field is applied to the transparent electrode 6 as in FIG. 4A, the pigment 5 in the clouded liquid 4 is attracted upward and if the flexible medium is viewed from the top of the figure, the color of the pigment 5 appears.

After this, if the external electric field is removed, the pigment 5 continues the state because of friction with the wall face of the microcapsule (FIG. 4B).

If an external opposite electric field is applied as in FIG. 4C, the pigment 5 in the microcapsule 7 is attracted downward in the figure, thus the color of the clouded liquid 4 appears.

As the capsule-type flexible medium in the magnetic field mode shown in FIG. 5, magnetic powder 5' is mixed into a medium 4', a thin layer of a transparent magnetic substance 6" is provided on the surface, and a magnetic field is applied with a magnet (magnetic head) 6'.

If the magnet 6' is brought close to the capsule-type flexible medium from the outside, the magnetic powder 5' in the medium 4' is attracted upward in the figure because of the magnetic field. Thus, if the capsule is viewed from the top of the figure, the magnetic powder 5' appears in black (FIG. 5A).

After this, if the magnet 6' is removed, the state is maintained because of the residual magnetism in the thin layer of the transparent magnetic substance 6" and black of the magnetic powder 5' continues.

If the magnet 6' is brought close to the bottom of the capsule-type flexible medium, the magnetic powder 5' in the medium 4' is attracted downward in the figure because of the magnetic field. Thus, if the capsule is viewed from the top of the figure, black of the magnetic powder 5' disappears and color of the medium 4' appears (FIG. 5C).

Of course, a magnetic head can be used in place of the magnet. In this case, as the magnetic head, in principle, a coil is wound around a core of ferrite, cobalt, etc., and is energized for producing a magnetic flux; various designs are made for providing multichannels and one-dimensional or two-dimensional full-line multiheads with A4 at 450 dpi and several thousand channels or more can also be provided by adopting a head array, etc.

As the microcapsule-type flexible medium in the magnetic field mode shown in FIG. 6, for example, a large number of microcapsules 7 each comprising magnetic powder 5' attracted in a magnetic field, mixed into a medium (for example, clouded liquid) 4' are sealed in a transparent magnetic binder 8' and a magnetic field is applied with a magnet 6'.

When an external magnetic field is applied from the magnet 6' as in FIG. 6A, the magnetic powder 5' in the clouded liquid 4 is attracted upward and if the flexible medium is viewed from the top of the figure, the magnetic powder 5' appears in black.

After this, if the external magnetic field is removed, the magnetic powder 5' continues the state because of the residual magnetism in the transparent magnetic binder 8' (FIG. 6B).

If an external opposite magnetic field is applied as in FIG. 6C, the residual magnetism in the transparent magnetic binder 8' is demagnetized and the magnetic powder 5' in each microcapsule 7' is dispersed in the medium 4' and color of the medium 4' appears.

Of course, a magnetic head can be used in place of the magnet. In this case, as the magnetic head, in principle, a coil is wound around a core of ferrite, cobalt, etc., and is energized for producing a magnetic flux; various designs are made for providing multichannels and one-dimensional or two-dimensional full-line multiheads with A4 at 450 dpi and several thousand channels or more can also be provided by adopting a head array, etc.

FIGS. 7A and 7B are drawings to show the magnetization characteristic of a magnetic substance to describe the principle of a flexible medium in a heat, magnetic mode. Normally, if a magnetic field is applied to a record material of a magnetic substance by a magnetic head at a low temperature, large magnetization is left because the record material has a large antimagnetic force and large residual magnetism, and a large hysteresis characteristic shown in FIG. 7A is shown and meanwhile, magnetization is stably held.

However, as the temperature of such a ferromagnetic substance is raised, as shown in FIG. 7B, the hysteresis characteristic becomes gradually narrow, and when curie temperature is reached in the end, spontaneous magnetization becomes zero and the nature as the ferromagnetic substance is lost.

Using this phenomenon for write with a magnetic head, the hysteresis characteristic at low temperature as in FIG. 7A is heated, thereby shifting to the characteristic as in FIG. 7B for promoting speeding up on/off control, and enabling control of high-temperature demagnetization, high-temperature magnetization inversion, etc., by also using a heating element.

Since the magnetic head can be thus controlled according to temperature, rewrite in a temperature mode is also enabled.

The description has been given with reference to FIGS. 2 to 7 in electrode or magnet (magnetic head) units. The flexible medium 2 in FIG. 2 comprises a matrix of a large number of such electrode or magnet (magnetic head) units and transparent wiring required for each unit is installed and is connected to a CPU 21 in FIG. 9.

Thus, a scroll is formed of a writable and erasable flexible display medium using electrophoretic effect or magnetic-phoretic effect, providing an easy-to-handle display like a scroll.

FIGS. 8A to 8E show specific examples of writing and reading configurations onto or from the display of the flexible medium 2. FIGS. 8A and 8B show examples of scanning up and down and writing with a line head 86, etc. FIG. 8C shows an example of writing with a magnetic head 87. FIG. 8D shows an example of additional writing and erasing with a magnetic pen 88. The screen can be traced with the magnetic pen 88 for additional writing and erasing. FIG. 8E shows an example of reading an additionally written or erased screen with the magnetic pen 88, etc., through a CCD line scanner 89.

Figure 9:
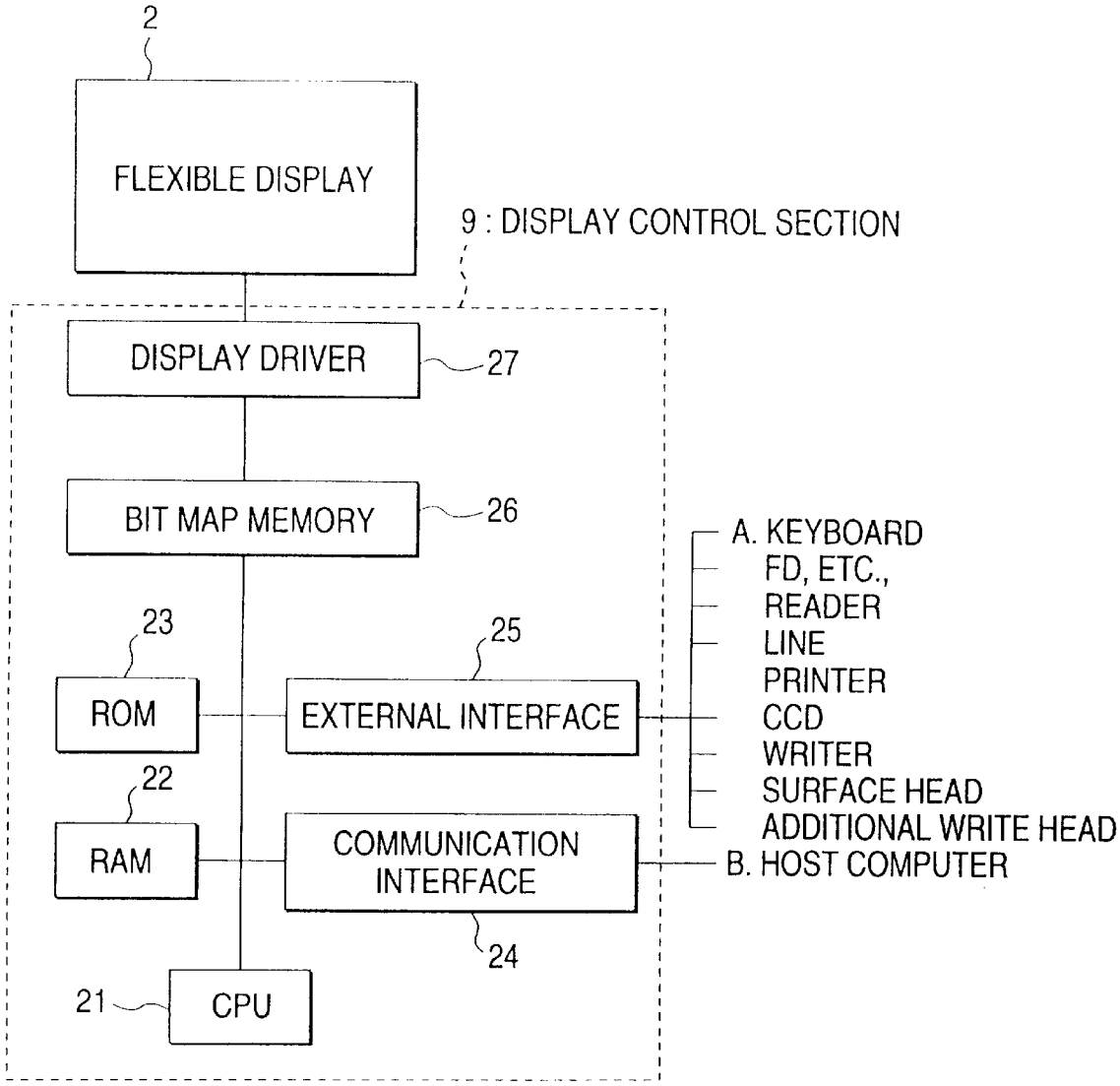
FIG. 9 is a block diagram to show the configuration of a control section for controlling the scroll-type display.

The display screen is scanned from top to bottom for reading an image and the read data can be input to memory 22 in FIG. 9 in the magazine 3 and can be transferred. The writing and reading arts are known and will not be discussed here.

In the scroll-type display 1 shown in FIG. 1, the operation of write with the write heads 32, erasion with the erasion heads 36, read with the scanners 33, additional write and erasion with the write pen 39, etc., is also performed in a similar manner to that described.

In this case, the read and write heads are arranged in the length direction of the scroll in FIG. 8, but in the magazine in FIG. 1, the read and write heads are arranged in the width direction of the scroll.

Thus, the writable and erasable flexible display medium using magnetic- phoretic or electrophoretic effect is formed like a scroll as shown in FIG. 1, whereby a display unit also excellent in portability can be provided and various display modes can be presented.

FIG. 9 is a block diagram to show the configuration of a display control section (personal computer) for controlling display of the scroll-type display 2.

The display control section 9 controls display of the scroll-type display 2 and comprises a CPU 21, ROM 22, RAM 23, an external interface 24, a communication interface 25, bit map memory 26, and a display controller 27. An additional write pen, a keyboard, a CCD scanner, a writer, a reader, a surface head, magnetic disk, FD, and the like are connected to the external interface 24.

The CPU 21 performs data processing by communicating with a center host (not shown), controls the bit map memory 26, and controls data interpretation processing in the RAM 23, namely, displays data concerning display in the RAM 23 on the scroll-type display 2 via the external interface 24 and stores display information transferred from the CCD scanner, the reader, etc., via the external interface 24 in the RAM 23. The ROM 22 stores arithmetic processing procedures of the CPU 21.

The communication interface 25 interfaces with the center host in data communication.

The bit map memory 26 stores data directly recorded on the scroll-type display 2 (bit map data), of data concerning display of data received by the CPU 21 from the center host.

The display controller 27 displays the bit map data in the bit map memory 26 on the scroll-type display 2.

The RAM 23 stores data other than the bit map data and display information transferred from the CCD scanner, the reader, etc., via the external interface 24.

The additional write pen is used to write, correct, delete, and additionally write information on the scroll-type display 2.

The keyboard is used to write, read, prepare, change, monitor, and save various programs.

The scanner is used to read information on the scroll-type display 2.

The writer is used to write information onto the scroll-type display 2. If a simple program is written, read, prepared, changed, monitored, saved, etc., it is convenient to provide the operation keys 34 (FIG. 1) and the additional pen with a part of the keyboard function.

Figure 10:
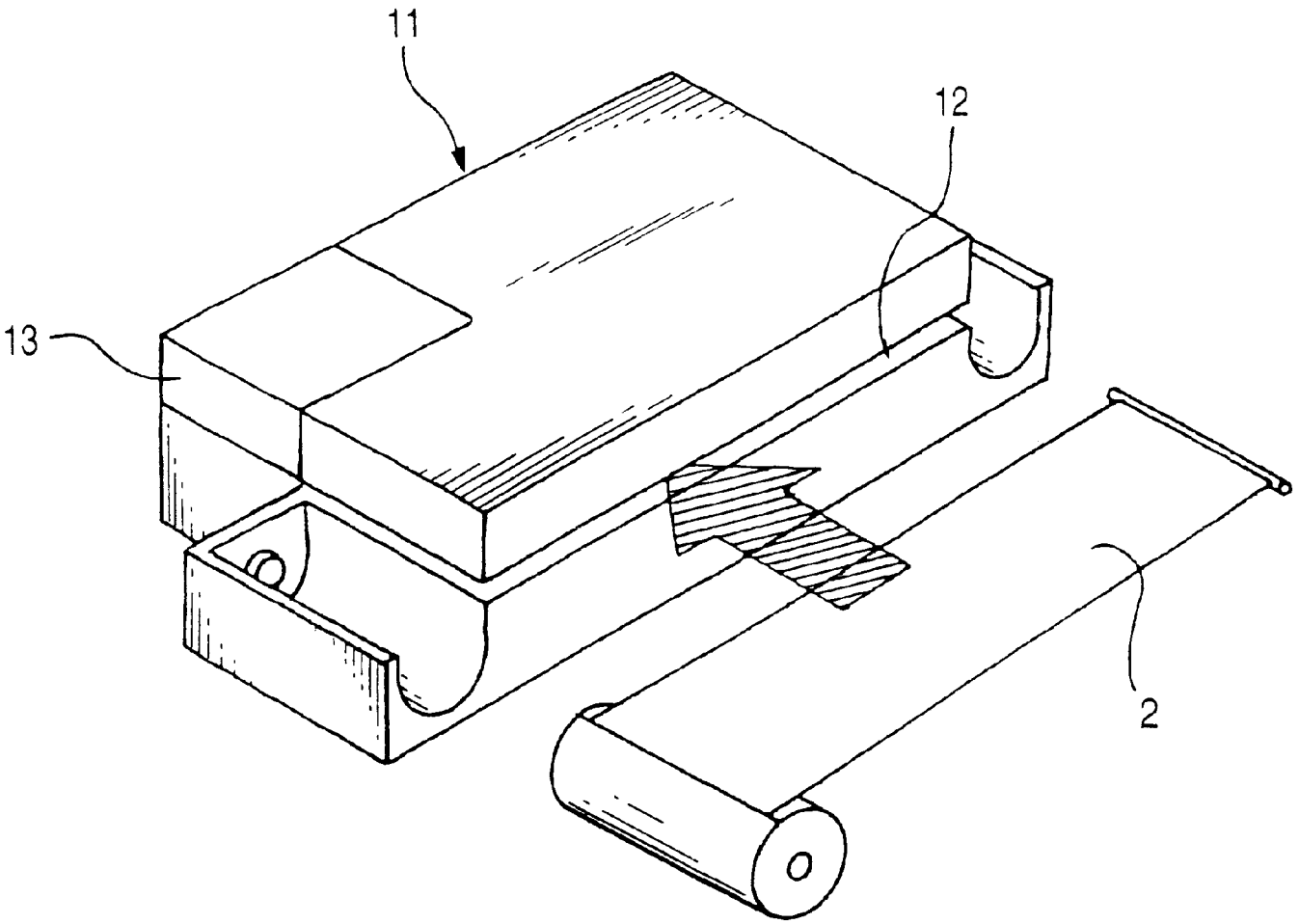
FIG. 10 is a perspective view of a tabletop writer/reader used with the invention.

FIGS. 8A to 8E show examples of writing and reading by line scanning; FIG. 10 is a perspective view of a high-speed tabletop writer/reader capable of executing surface scanning.

In FIG. 10, numeral 11 denotes a writer/reader onto/from the scroll-type flexible medium according to the invention. The magnetic heads used with the writer/reader can also be multiheads of high-density multichannels by applying thin-film technology, vertical recording, etc., and writing is executed in batch with a two-dimensional array. Thus, with one page of A4-size paper at about 300 dpi, the write time is fairly short as compared with that of a line head, etc., namely, can be about 0.1 sec.

For example, with the magnetic head type, writing is executed based on magnetic flux change caused by an electric current allowed to flow in response to an image signal for each single head, and reading is executed based on change in an induced current flowing into magnetic elements from the magnetic substances of the display medium 2.

Numeral 12 denotes an insertion slot of the paper-like display 2 and numeral 13 denotes communication means with the host computer. Handing the writer/reader will be discussed. A desired portion of the flexible medium 2 is drawn out from the scroll-type display 1 and the flexible medium 2 is inserted into the insertion slot 12 of the writer/reader 11. When the flexible medium 2 is inserted, the writer/reader 11 writes one page of A4-size paper in batch at high-speed printing of 0.1 sec or less by means of two-dimensional multiheads based on the transferred data from a computer (not shown, for example, the host computer in the head office, etc.,).

If there is a drawing, a changed screen etc., to be transferred from the flexible medium 2 to the computer, the flexible medium 2 is inserted into the insertion slot 12 of the writer/reader 11, whereby the writer/reader 11 reads the drawing, screen, etc., in batch and transfers the read data to the computer through the communication means 13. The flexible medium 2 is erased and written only when screen output information from the computer changes at the writing time.

The writer/reader for writing/reading onto/from the sheet-like flexible medium 2 using magnetic-phoretic effect has been described; a known electric writer/read can also be placed for use in a similar manner if a medium using electrophoretic effect is used.

Next, a second embodiment of the invention will be discussed with reference to FIG. 11.

Figure 11:
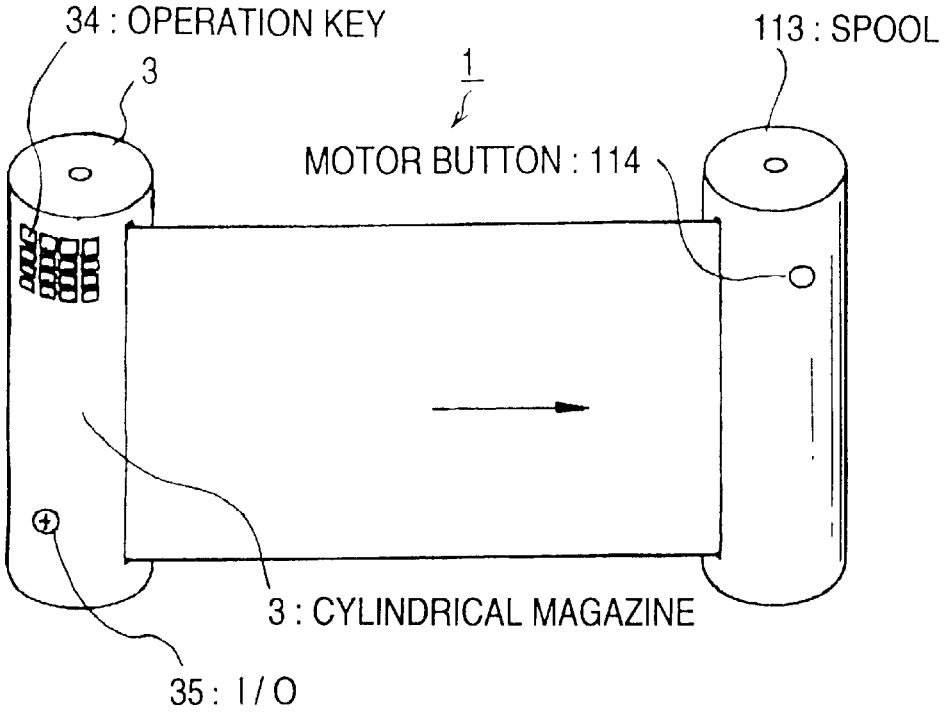
FIG. 11 is a perspective view of a scroll-like flexible medium display that can be automatically wound and rewound according to a second embodiment of the invention.

FIG. 11 is a perspective view of a scroll-like flexible medium display that can be automatically wound and rewound according to the second embodiment of the invention.

In the figure, a spool 113 contains a motor (not shown) and can wind and display and rewind a scroll-like flexible medium 2 just like a film cartridge and a film winding spool. A button 114 is an operation button for driving the motor.

A cylindrical magazine type case 3 has the same configuration as that in the first embodiment; the operation of write with write heads 32, erasion with erasion heads 36, read and transfer with scanners 33, additional write with a write pen 39 or a magnetic pen 88, etc., is performed in a similar manner to that in the first embodiment.

Thus, automatic winding and rewinding can be performed in the second embodiment in FIG. 11, so that the image (still image) to be displayed can be drawn out as desired and can remain displayed as much as the user desires.

As an improvement example of the second embodiment, the same function as the magazine 3 may be provided in the spool 113. That is, the spool 113 contains only the motor system for making it possible to automatically wind and rewind the flexible medium in the second embodiment; the spool 113 contains the write heads 32, the erasion heads 36, the scanners, etc., as in the first embodiment and is provided with the same function as the magazine 3, whereby the operation of write with the write heads 32, erasion with the erasion heads 36, read and transfer with the scanners 33, etc., can also be performed in the spool 113, so that the operability of the flexible medium display is furthermore enhanced.

Figure 12:
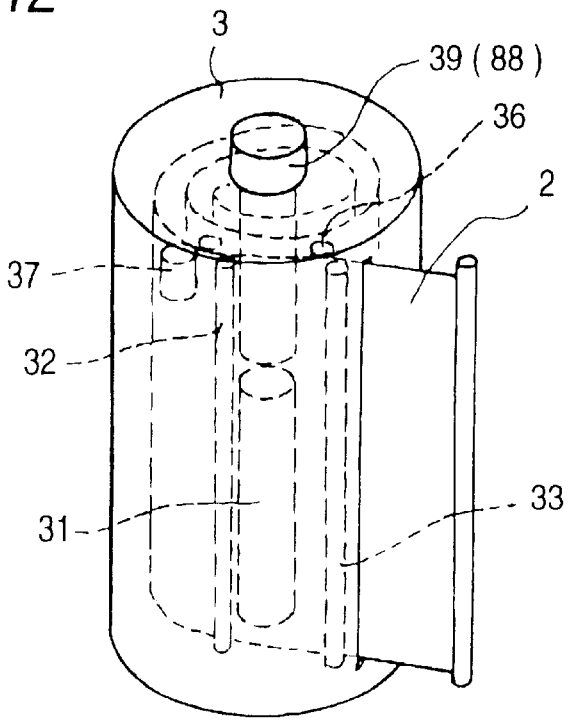
FIG. 12 is a perspective view to show a state in which an additional write pen is attached according to a third embodiment of the invention.

In a third embodiment of the invention, an additional write pen (pen-type head) 39 or 88 can be attached to and detached from the center axis portion of a cylindrical magazine type case 3 as shown in FIG. 12. In the figure, numeral 39 (88) denotes the additional write pen, and the additional write pen 39 (88) is stored in the center axis portion of the cylindrical magazine type case 3. In doing so, when the additional write pen 39 (88) is not used, it is stored in the center axis portion of the magazine type case 3, whereby they can be handled in one piece conveniently. Parts identical with those previously described with reference to FIG. 1B are denoted by the same reference numerals in FIG. 12.

As described above, according to the invention, the writable and erasable flexible medium which continues display if the drive source is removed as display is stored in the cylindrical magazine type case like a scroll so that the flexible medium can be rewound, so that the display becomes portable and easy to handle. Further, the spool of the same shape as the cylindrical magazine type case capable of automatically winding and rewinding the scroll-like flexible medium is placed on the opposite side to the cylindrical magazine type case, so that image display becomes more flexible and the operability is enhanced.

What is claimed is:

1. A continuously displayable scroll-type display, comprising:

a flexible medium which is writable, erasable and continuously displayable of an image;

a cylindrical magazine type case for storing the flexible medium in a scroll form so that the flexible medium can be wound and/or rewound; and a content display control section, containing a first CPU (central processing unit) for controlling content display of the flexible medium, in the cylindrical magazine type case.

2. The continuously displayable scroll-type display as claimed in claim 1 wherein the display displays the image based on an electrophoretic effect or magnetic-phoretic effect in the flexible medium.

3. The continuously displayable scroll-type display as claimed in claim 2 wherein the flexible medium contains a mix layer of a particle containing a color substance and a fluid opaque medium.

4. The continuously displayable scroll-type display as claimed in claim 2 wherein the flexible medium contains a mix layer of a particle containing a magnetic substance and a fluid opaque medium.

5. The continuously displayable scroll-type display as claimed in claim 1 wherein the display control section includes a communication function with a host computer.

6. The continuously displayable scroll-type display as claimed in claim 1 or 5 wherein the display control section includes read and/or write functions and erasion function of the flexible medium.

7. The continuously displayable scroll-type display as claimed in claim 6 wherein the write function is performed by means of a write head comprising an array of a plurality of magnetic elements.

8. The continuously displayable scroll-type display as claimed in claim 6 wherein the write function is performed by means of a write head comprising a plurality of magnetic field generators and heating elements.

9. The continuously displayable scroll-type display as claimed in claim 6 wherein the write function is performed by means of a pen type head capable of additional write and erasion.

10. The continuously displayable scroll-type display as claimed in claim 9 wherein the pen type head can be attached to and detached from the cylindrical magazine type case.

11. The continuously displayable scroll-type display as claimed in claim 1 wherein a spool of the same shape as the cylindrical magazine type case capable of automatically winding and rewinding the scroll-like flexible medium is placed on an opposite side to the cylindrical magazine type case.

12. The continuously displayable scroll-type display as claimed in claim 11 wherein the spool contains at least one of a second CPU, a write head, an erasion head, a read scanner, and an encoder and/or an I/O terminal on the outside of the spool for enabling communication with a computer.

13. The continuously displayable scroll-type display as claimed in claim 12 wherein said computer is the first CPU.

14. The continuously displayable scroll-type display as claimed in claim 12 wherein said computer is the host computer.

* * * * *